US006357405B1

(12) United States Patent
Tsuji et al.

(10) Patent No.: US 6,357,405 B1
(45) Date of Patent: Mar. 19, 2002

(54) VALVE DRIVE MECHANISM OF FOUR-STROKE CYCLE ENGINE

(75) Inventors: Kouichi Tsuji; Toshihiko Yoneta; Uichiyama Shigenobu, all of Iwata (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 09/715,214

(22) Filed: Nov. 17, 2000

(30) Foreign Application Priority Data

Dec. 10, 1999 (JP) ..... 11-351362

(51) Int. Cl.[7] ..... F01L 1/34; F02D 13/02

(52) U.S. Cl. ..... 123/90.16; 123/90.22; 123/90.39

(58) Field of Search ..... 123/90.15, 90.16, 123/90.22, 90.39, 90.4, 90.42, 90.44

(56) References Cited

U.S. PATENT DOCUMENTS

| | | | | |
|---|---|---|---|---|
| 5,189,998 A | * | 3/1993 | Hara | 123/90.16 |
| 5,732,669 A | * | 3/1998 | Fischer et al. | 123/90.16 |
| 5,899,180 A | * | 5/1999 | Fischer | 123/90.16 |
| 6,019,076 A | * | 2/2000 | Pierik et al. | 123/90.16 |
| 6,145,485 A | | 11/2000 | Bidlingmaier et al. | 123/90.16 |

* cited by examiner

*Primary Examiner*—Weilun Lo
(74) *Attorney, Agent, or Firm*—Ernest A. Beutler

(57) ABSTRACT

An improved variable valve timing mechanism that is operative to provide an arrangement for varying both the valve lift and lift curve in response to dynamic running conditions. A variable valve timing mechanism is also incorporated in the cam drive so as to further widen the range of adjustment of valve timing.

11 Claims, 3 Drawing Sheets

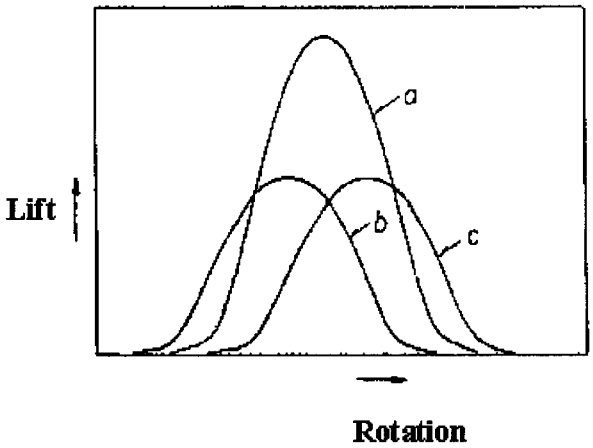
Figure 5
Figure 6
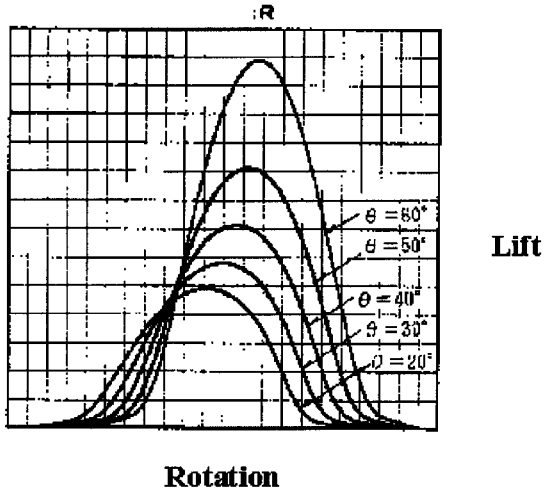
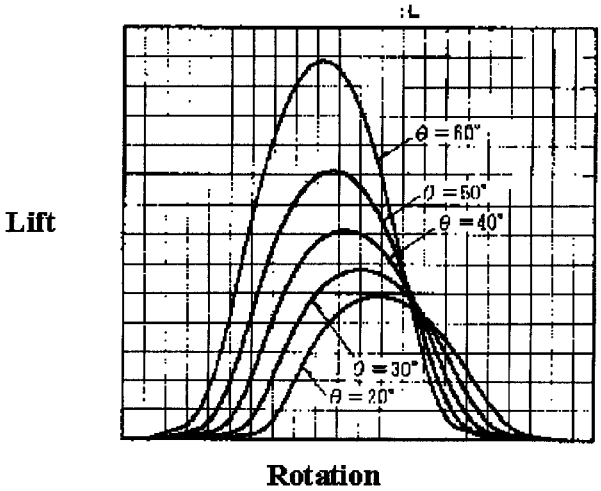
Figure 7

VALVE DRIVE MECHANISM OF FOUR-STROKE CYCLE ENGINE

BACKGROUND OF THE INVENTION

This invention relates to a valve drive mechanism for a four-stroke cycle engine and more particularly to an arrangement for more fully controlling the valve operation over wide ranges of engine running conditions.

It is well understood that the opening and closing of the intake and exhaust valves of a four-cycle engine is particularly important in determining the engine performance. Conventional valve timing mechanisms have provided fixed lift curves and fixed duration for the individual valve operation. As a result, the valve timing and lift curve have been a compromise in order to provide good performance over a wide a range as possible.

In order to further improve the performance of an engine, it has been proposed to employ a variable valve timing mechanism which can be utilized to shift the phase of the valve opening and closing to vary overlap between the opening of the intake and exhaust valves under some running conditions to improve performance. Under other running conditions, the overlap is eliminated in order to improve running under those other conditions.

It is has also been recognized that there are advantages in changes the actual lift of the valve and the actual shape of the lift curve. This has generally been accomplished by using a plurality of cam lobes for operating an individual valve with varying types of mechanisms for determining which cam lobe operates the valve at a given running condition.

It has also been proposed to utilize both the variable valve timing and variable valve lift mechanisms in the same engine. However, this combination provides a very complicated structure and generally requires a number of cams, followers and a hydraulic mechanism for varying the valve timing and lift. In addition, these mechanisms do not make is possible to obtain continuously variable timing and lift for the most part.

It is, therefore, a principal object to this invention to provide an improved valve operating mechanism for a four cycle engine wherein both the lift curves and timing curves can be adjusted by simple mechanisms that do not require expensive or complicated controls or hydraulic circuitry.

It is a further object to this invention to provide a variable valve lift and timing mechanism for an engine wherein both lift and the timing curve can be adjusted without utilizing complicated structures and multiple lobe camshafts and followers.

It is a still further object to this invention to provide an improved and simplified valve operating mechanism for a four cycle engine that provides a wide range of adjustments in valve operation during actual engine running with minimum components and control mechanisms.

SUMMARY OF THE INVENTION

This invention is adapted to be embodied in a four-cycle engine having at least one poppet type valve supported for movement between an open and closed position for fluid interchange with a combustion chamber of the engine. A single rotating cam is associated with the valve. An actuating mechanism is interposed between the single rotating cam and the valve for operating the valve and for adjusting both the degree of lift and the lift curve of the valve so as to change the timing and lift operation of the valve.

BRIEF DESCRIPTION OF THE DRAWINGS

FIG. 5 is a graphical view showing the extreme variations possible in valve lift and valve timing in accordance with the invention.

FIG. 6 is a graphical view, in part similar to FIG. 5, and shows the possible variations and adjustments in one direction of camshaft rotation.

FIG. 7 is a graphical view, in part similar to FIG. 6, and shows the possible variations when the camshaft is rotating in the opposite direction from that shown in the previous figure.

DETAILED DESCRIPTION OF THE PREFERRED EMBODIMENT OF THE INVENTION

Figure 1:
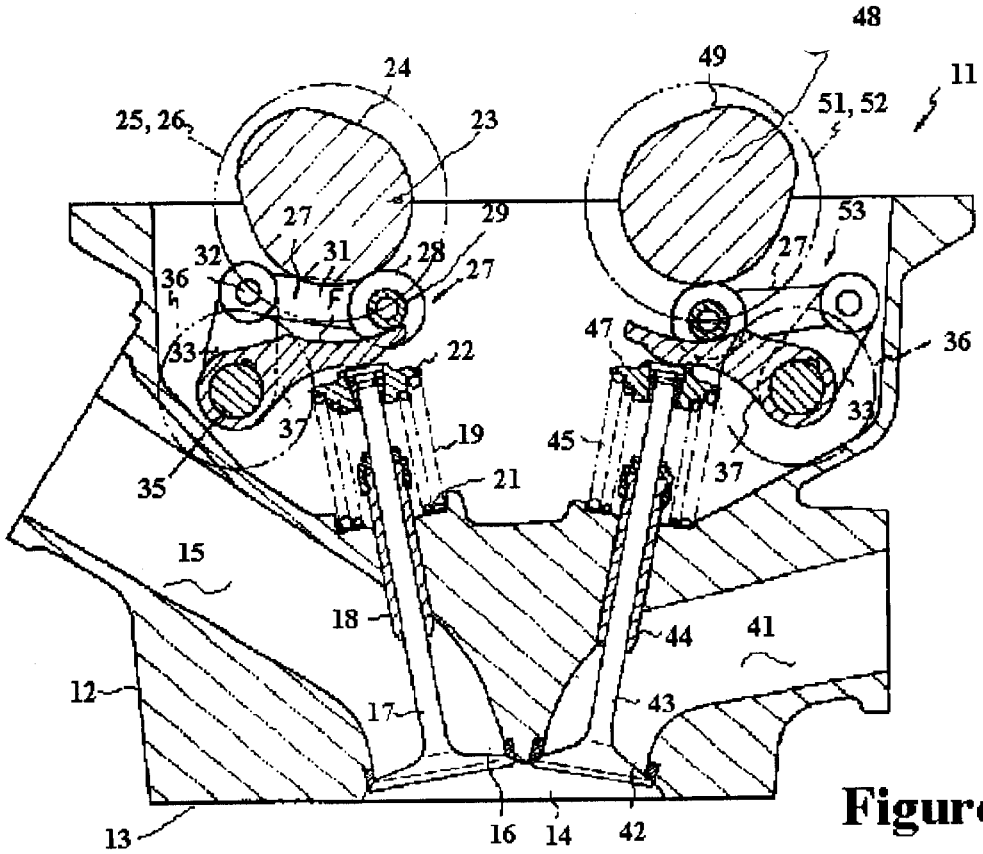
FIG. 1 is a cross sectional view taken though the cylinder head of a four-stroke internal combustion engine constructed in accordance with an embodiment of the invention, with the cam cover of the cylinder head assembly removed.
Figure 2:
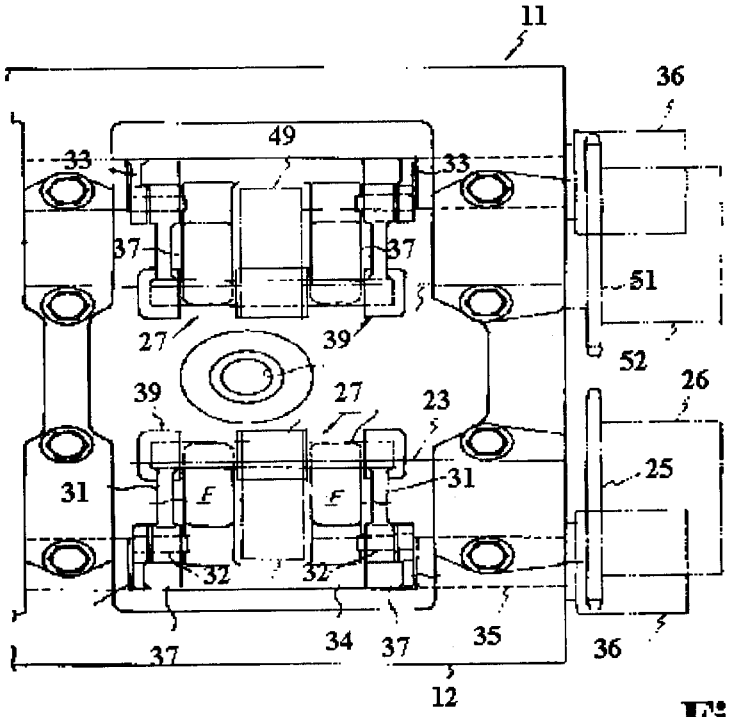
FIG. 2 is a top plan view of the mechanism shown in FIG. 1.
Figure 3:
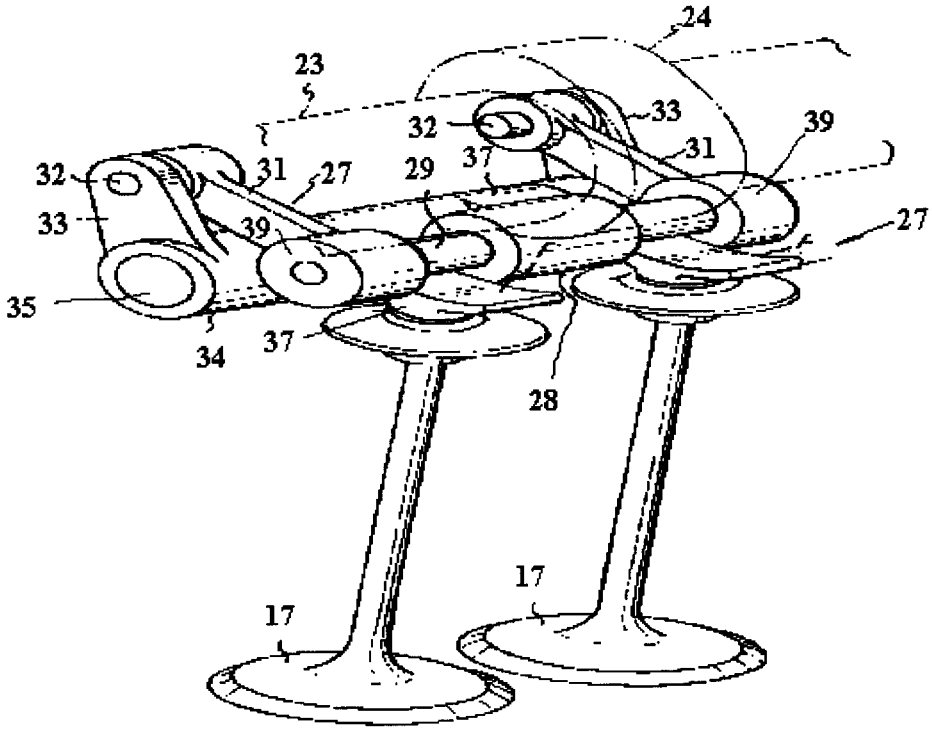
FIG. 3 is a perspective view showing the valve operating mechanism associated with the intake valves and which is typical of that of the exhaust valves.

Referring now in detail to the drawings and initially primarily to FIGS. 1 through 4, a cylinder head assembly constructed in accordance with an embodiment of the invention is shown partially and is identified generally by the reference numeral 11. The invention is described in connection with an overhead valve, twin overhead cam cylinder head assembly. Therefore, in order to understand the invention, it is believed only necessary for those skilled in the art to be presented with the drawings of the cylinder head assembly. Those skilled in the art will readily understand how the invention can be utilized with the remaining components of any desired engine construction.

The cylinder head assembly 11 includes a main cylinder head member 12 that has a lower surface 13 that is adapted to be affixed in sealing relationship with an associated cylinder block having one or more cylinder bores. Recesses 14 formed in the cylinder head surface 13 cooperate with the cylinder bores and the pistons that reciprocate therein to form the combustion chambers of the engine.

In the illustrated embodiment, the engine having the cylinder head 11 is depicted as being of the four valves per cylinder type although it will be apparent to those skilled in the art how the invention can be employed with engines having other numbers of valves. In addition, although the invention is shown in connection with an in-line engine, it should be readily apparent to those skilled in the art how the invention can be practiced with engines having other cylinder numbers and other cylinder configurations, such s V-type or opposed engines.

A pair of intake passages 15 extends through one side of the cylinder head member 12 and terminates at valve seats 16 which are valved by the heads of poppet type intake valves 17. The intake passages 15 are served by a suitable charging system, which may be comprised of an intake manifold as well as fuel injectors or other charge formers. In addition, the invention can be utilized in conjunction with direct injected, internal combustion engines.

The poppet type intake valves 17 are supported for reciprocation within valve guides 18 that are pressed, cast or otherwise placed in the cylinder head member 12. Alternatively, the cylinder head member 12 may form integral valve guides depending upon the materials, which are chosen.

Coil spring assemblies 19 are interposed between machined surfaces 21 of the cylinder head member 12 and keeper retainer assemblies 22 that are affixed to the upper ends of the stems of the intake valves 17. These spring assemblies 19 hold the valves 17 in their closed positions, as is well known in the art.

An overhead intake camshaft 23 having cam lobes 24 is rotatably journalled in the cylinder head member 12 in an appropriate manner. This intake camshaft 23 is driven, preferably, by a cam drive from the crankshaft of the engine at one half-crankshaft speed. This cam drive may include a sprocket 25, which drives the camshaft 23 through a variable valve timing mechanism 26 of any known type.

An actuating mechanism, indicated generally by the reference numeral 27, is interposed between the cam lobe 25 and the two intake valves 17 for each cylinder of the engine. Thus, a single cam lobe is all that is necessary to operate the two intake valves 17. It should be readily apparent, however, from the following description that if desired each valve 17 may be controlled and operated independently from a respective cam lobe or cam lobes utilizing a mechanism of the type indicated by the reference numeral 27 depending upon the engine performance required.

This mechanism 27 includes a roller follower 28 that is journalled on a shaft 29 and which is engaged with the cam lobe 24. The ends of the shaft 29 are joumalled within a pair of spaced apart rocker arms 31 each of which is, in turn, pivotally supported on a pivot pin 32 carried by spaced apart arms 33 of a lever mechanism having a hub portion 34.

The hub portions 34 are fixed to a rocker shaft 35, which is, in turn, journalled for rotation about a fixed axis in the cylinder head member 12 in an appropriate manner. A servo motor 36 of the stepper type is fixed to an external surface of the cylinder head member 12 and rotates the shaft 35 and lever arms 33, in a manner, which will be described, so as to change the valve motion, in a manner, which will also be described later.

The shaft 29 is engaged with curved bearing surfaces F of valve operating rocker arms 37, each of which have engaging portions 38 that are engaged with the keeper retainer assemblies 22 or the stems of the intake valves 17 for opening them. These rocker arms 37 are fixed to a common boss portion and are journalled for pivotal movement relative to and about the pivot pin 35 that operates the lever arms 33. It should be noted that the rocker arms 31 have enlarged outer end parts 39 which embrace the outer sides of the rocker arms 37 and trap them between the follower roller 28.

The radius of curvature of the follower sections F of the rocker arms 37 is coincident with the axis of rotation of the intake camshaft 23 when the intake valves 17 are in their closed position. The lift and timing curve for opening of the intake valves 17 can be adjusted, as will be described in conjunction with FIGS. 5 through 7 by rotating the shaft 35 and the lever arms 33 so as to move the location where the shaft 29 contacts the rocker arms 37. This adjustment will vary the motion of the rocker arms 37 and the associated valves 17. This structure will be described later by primary references to FIGS. 4 through 7.

Continuing now to describe the remainder of the construction of the cylinder head assembly 11, a pair of exhaust passages 41 are formed in the cylinder head member 12 on the side opposite from the intake passages 15. These exhaust passages 41 begin at exhaust valve seats 42 that are formed suitably in the cylinder head member 12 and terminate in an outer surface of the cylinder head member 12 to which a suitable exhaust manifold (not shown) may be affixed.

Poppet type exhaust valves 43 are supported for reciprocation in the cylinder head member 12 by valve guides 44. Like the intake valve guides 18, these exhaust valve guides 44 may be pressed, cast or otherwise formed with the cylinder head member 12.

Coil spring assemblies 45 act against machine cylinder head surfaces 46 and keeper retainer assemblies 47 that are affixed to the upper ends of the stems of the exhaust valves 43 in a well-known manner. An exhaust camshaft 48 is rotatably journalled in the cylinder head assembly 11 in a suitable manner and has cam lobes 49 for opening the exhaust valves 43. The exhaust cam shaft 48 is driven from the engine crankshaft at one half crankshaft speed by a suitable drive like the intake cam shaft 23. This includes a drive sprocket 51 and variable valve timing mechanism 52.

A variable valve lift mechanism, indicated generally by the reference numeral 53 and having the same construction as the variable valve lift mechanism 27 associated with the intake valves 17, transmits motion from the cam lobes 49 to the exhaust valves 43. Since the construction of the variable valve lift mechanism 53 is the same as that associated with the intake system, it components have been identified by the same reference numerals and it will not be described again. Also, the following description of the operation of the intake valve actuating system 27 will apply also to that of the exhaust valve actuating system 51.

The operation of the mechanism 27 for controlling the lift and timing of the lift will now be described in detail by reference to FIGS. 4 through 7. It should be understood that the description would be the same for the exhaust side and those skilled in the art will readily understand this from the following description.

Figure 4:
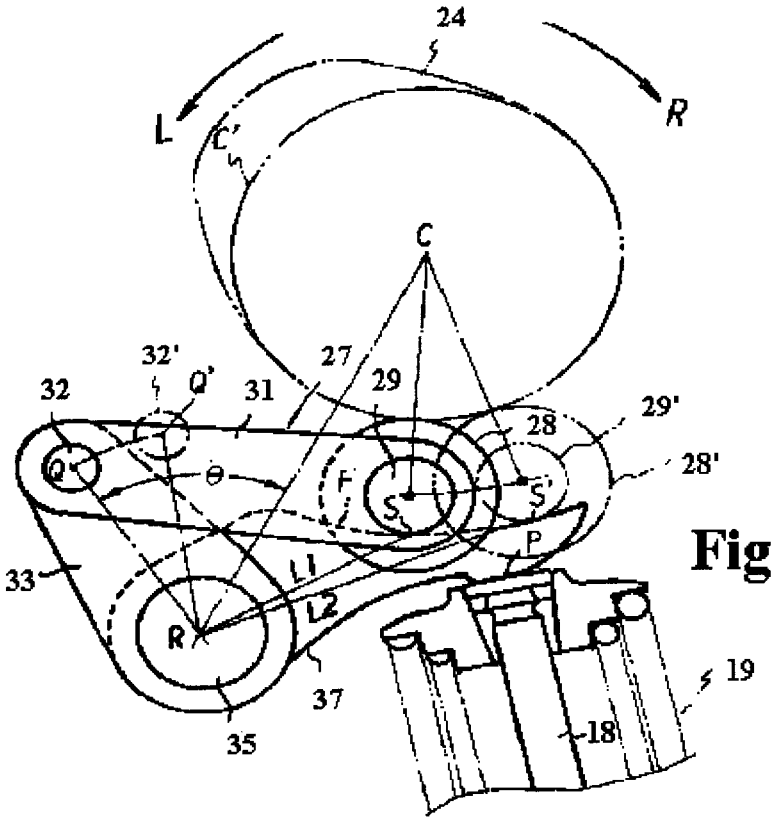
FIG. 4 is an enlarged view looking in the same direction as FIG. 1 and shows the operation of the intake valves and how the lift and timing curves are adjusted.

In FIG. 4, the camshaft 23 is initially assumed to be rotating in a clockwise direction as indicated by the arrow R. When the lever arm 33 is rotated to the position shown in FIG. 1 and shown in phantom in FIG. 4, the contact point of the shaft 29 at the point S' will be disposed slightly outwardly beyond the point of contact of the rocker arm follower portion 38 with the valve stem 18 indicating at the point P. The point P will stay relatively constant regardless of the angle of the lever 33.

Thus, as the camshaft 23 rotates in the direction indicated by the arrow R, the lift curve B of FIG. 5 will occur where the intake valves 19 begin to open relatively soon but have a relatively low lift due to the long effective length of the lever arm R-S'. This length is indicated at L2.

If the rocker arm shaft 35 is rotated in counter clockwise direction through the angle θ, the contact point S with the surface F moves inboard of the point P and the effective lift will be increased significantly as seen by the curve A which is the resulting curve when the mechanism is in the solid line position shown in FIG. 4. The effective length of the rocker arm 37 in this condition is L1 (R-S). However, the lift begins later and also closing begins later so that the valve timing is also altered. Of course, the timing can be maintained the same by utilizing the variable valve timing mechanism 26 associated with the intake camshaft 23 so as to adjust the position of these curves. Thus, between these positions there is a plurality of positions as shown in FIG. 6.

If the rotation of the camshaft 23 is in the opposite direction i.e. counter clockwise as indicated by the arrow L, then the lift curve C will result because at this stage the follower will be engaged later. Thus, if the rotation is in the opposite direction a family of curves as shown in FIG. 7 will result.

Therefore, it should be readily apparent that the described mechanism provides a very simple and highly effective way of changing both the lift and timing of the valve opening during engine running with a minimum number of components and a minimum number of control mechanisms. Of course, it should be readily apparent that the foregoing description is that of a preferred embodiment of the invention and that various changes and modification may be made without departing from the spirit and scope of the invention, as defined by the appended claims.

What is claimed is:

1. A four-cycle engine having a combustion chamber and at least one poppet type valve supported for movement between an open and closed position for fluid interchange with said combustion chamber, a single rotating cam associated with said valve, an actuating mechanism interposed between said single rotating cam and said valve for operating said valve and for adjusting both the degree of lift and the lift curve of said valve so as to change the timing and lift operation of said valve, said actuating mechanism comprising a first rocker arm supported for pivotal movement about a first rocker arm axis and having an end thereof in operative engagement with said valve for operating said valve, a second rocker arm interposed between said first rocker arm and said cam lobe and moveable relative to said first rocker arm and said cam lobe, said second rocker arm being supported for pivotal movement about a second rocker arm axis, and an operating lever pivotal about said first rocker arm axis for moving said second rocker arm axis relative to said first rocker arm axis.

2. A four-cycle engine as set forth in claim 1 wherein the first rocker arm axis is defined by an operating shaft operated by a servo motor.

3. A four-cycle engine as set forth in claim 2 further including a variable valve timing mechanism for varying the timing of rotation of the camshaft relative to an output shaft of the engine.

4. A four-cycle engine as set forth in claim 1 wherein there are a pair of valves each operated by the same single cam lobe.

5. A four-cycle engine as set forth in claim 4 wherein the pair of valves are each operated by a respective first rocker arm supported for pivotal movement about a respective first rocker arm axis and having an end thereof in operative engagement with the respective valve, said first rocker arms being both actuated through a common actuating mechanism.

6. A four-cycle engine as set forth in claim 5 wherein the common actuating mechanism comprises a common operating member interposed between each of the first rocker arms and the cam lobe and moveable relative to the first rocker arms and the cam lobe for varying the lift and timing of opening of the respective valve.

7. A four-cycle engine as set forth in claim 6 wherein the common operating member comprises a pair of spaced second rocker arms supported for pivotal movement about a common, second rocket aim axis.

8. A four-cycle engine as set forth in claim 7 wherein the means for moving the second rocker arm axis relative to the first rocker arm axis comprises a pair of operating levers.

9. A four-cycle engine as set forth in claim 8 wherein the operating levers are pivotal about the first rocker arm axis.

10. A four-cycle engine as set forth in claim 9 wherein the first rocker arm axis is defined by an operating shaft operated by a servo motor.

11. A four-cycle engine as set forth in claim 10 further including a variable valve timing mechanism for varying the timing of rotation of the camshaft relative to an output shaft of the engine.

* * * * *